US005394965A

United States Patent [19]

Kho

[11] Patent Number: 5,394,965

[45] Date of Patent: Mar. 7, 1995

[54] ATTACHABLE PULL HANDLE FOR SUITCASES

[76] Inventor: Dick T. Kho, P.O. Box 34454, West Los Angeles, Calif. 90034

[21] Appl. No.: 122,283

[22] Filed: Sep. 17, 1993

[51] Int. Cl.[6] ..... A45C 5/14; A45C 13/26

[52] U.S. Cl. ..... 190/115; 190/18 A; 16/115; 280/37

[58] Field of Search ..... 190/18 A, 18 R, 115, 190/117, 39; 280/47.29, 655, 655.1, 37; 16/115

[56] References Cited

U.S. PATENT DOCUMENTS

| | | | |
|---|---|---|---|
| 3,257,120 | 6/1966 | Browning | 190/18 A X |
| 3,522,955 | 8/1970 | Warner, Jr. | 190/18 A X |
| 3,606,372 | 9/1971 | Browning | 190/18 A X |
| 3,799,568 | 3/1974 | Hager | 190/18 A X |
| 4,132,489 | 1/1979 | Berg, Jr. et al. | 16/115 X |
| 4,256,320 | 3/1981 | Hager | 190/18 A X |
| 4,340,990 | 7/1982 | Seynhaeve | 190/115 X |
| 4,358,005 | 11/1982 | Fontana | 190/115 X |
| 4,358,006 | 11/1982 | Castelli | 190/18 A |
| 4,523,773 | 6/1985 | Holtz | 16/115 X |
| 4,621,404 | 11/1986 | Browning | 190/115 X |
| 4,759,431 | 7/1988 | King et al. | 190/18 A |
| 4,838,396 | 6/1989 | Krenzel | 190/18 A |
| 5,048,649 | 9/1991 | Carpenter et al. | 190/115 X |
| 5,181,590 | 1/1993 | Carpenter et al. | 190/18 A |
| 5,197,579 | 3/1993 | Bieber et al. | 190/115 X |
| 5,257,800 | 11/1993 | Yang | 280/655 X |
| 5,269,044 | 12/1993 | Marion | 16/115 X |
| 5,277,449 | 1/1994 | Schmidt | 280/655 |
| 5,330,037 | 7/1994 | Wang | 190/115 X |

FOREIGN PATENT DOCUMENTS

| | | | |
|---|---|---|---|
| 141352 | 5/1951 | Australia | 190/18 A |
| 2661807 | 11/1993 | France | 190/18 A |
| 2111465 | 7/1983 | United Kingdom | 190/115 |

*Primary Examiner*—Sue A. Weaver
*Attorney, Agent, or Firm*—Monty Koslover Assoc.

[57] ABSTRACT

The invention is an attachable pull handle for suitcases which are mounted on rollers. A pull handle is encased in a rectangular plastic housing with its hand grip portion protruding out. The housing is intended to be screwed to the top side of a suitcase. The pull handle is a rectangular cross-section rod with a hand grip at one end and two pins protruding 90 degrees to its axis at its other end. The housing cover includes a channel, allowing the pull handle rod to slide longitudinally inside the housing. A manually adjustable bridge stop is located about midway along the housing length, so that the pull handle may be used with only half its length extended, providing a rigid handle for pulling a suitcase. The pull handle can also be used fully extended and pivoted on the end of the housing at any comfortable angle for pulling a suitcase.

2 Claims, 2 Drawing Sheets

Fig. 4.
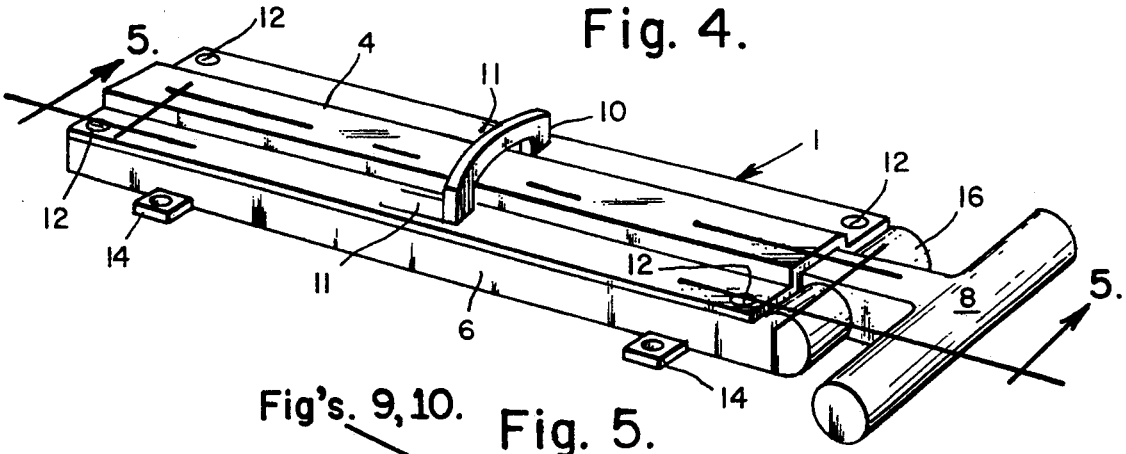
Fig's. 9,10.
Fig. 5.
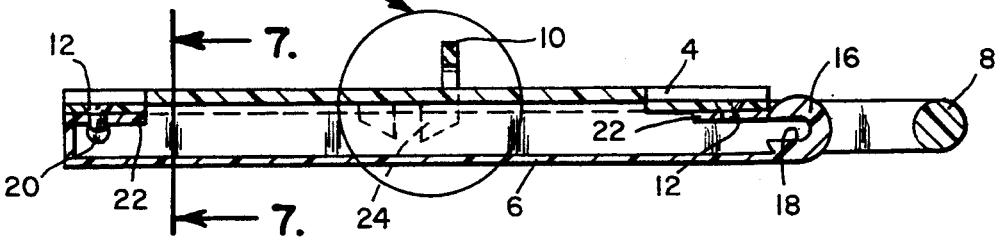
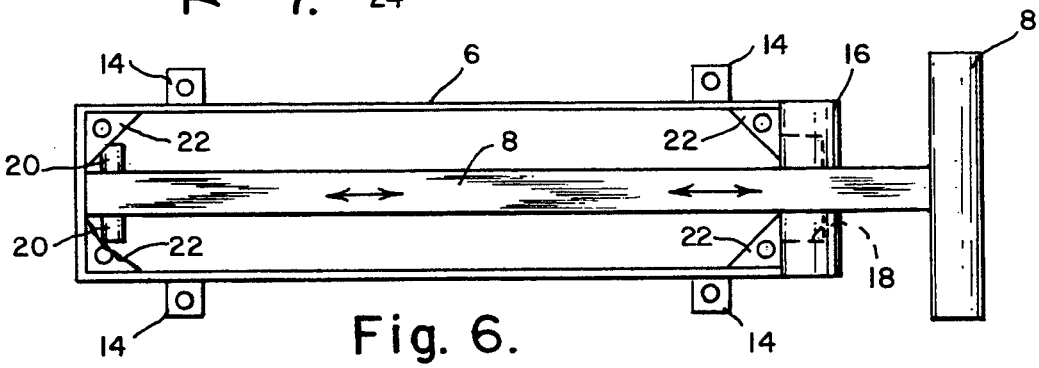
Fig. 6.
Fig. 7.
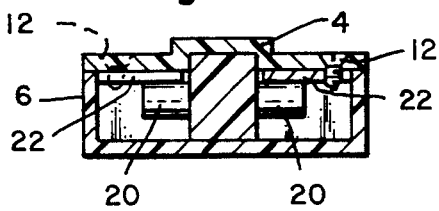
Fig. 9.
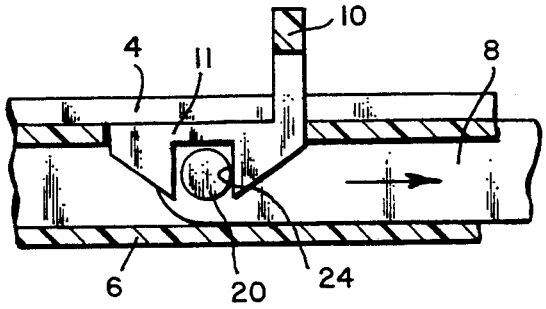
Fig. 10.
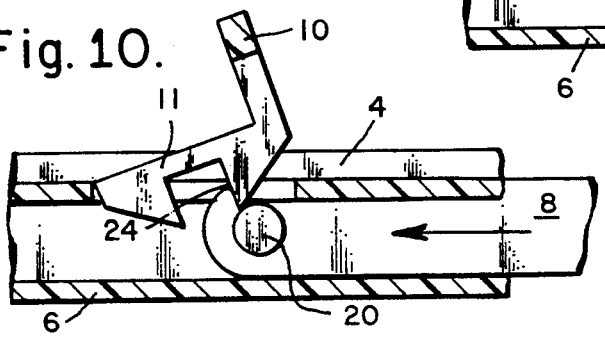

ATTACHABLE PULL HANDLE FOR SUITCASES

BACKGROUND OF THE INVENTION

This invention relates to luggage and in particular to handles which may be attached to suitcases having rollers.

Pull handles for luggage have been available for decades. Suitcases, both hard-sided and soft-sided, have in recent years incorporated mounted castered wheels or other means of rolling the luggage along, enabling the user to pull a suitcase along by its pull handle. The presently available luggage pull handles are typically built-in to the luggage and are complex in structure. Such arrangements are exemplified by the patents of Bieber et al., U.S. Pat. No. 5,197,579, Carpenter et al., U.S. Pat. No. 5,048,649, and Hager, U.S. Pat. No. 4,256,320. Certain rigid, attachable pull handle configurations are also known. These typically, are described by the patents of Castelli, U.S. Pat. No. 4,358,006, Seynhaeve, U.S. Pat. No. 4,340,990, and Krenzel, U.S. Pat. No. 4,838,396. The available handles are not stowable, but are open and have only a single position or length for pulling the suitcase in a trailing mode.

In studying their usage, it has been observed that a single position or handle length can be too short for taller than average persons or too long for short persons, particularly when the suitcase is to be pulled along airport terminal hallways.

There is thus a need for a simple, attachable pull handle for suitcases, the pull handle being stowable and having more than one position and length adaptable for use by both short and tall persons.

SUMMARY OF THE INVENTION

The invention is an attachable pull handle for suitcases which are mounted on rollers. A pull handle is encased in a rectangular plastic housing with its hand grip portion protruding out. The housing is intended to be screwed to the side of a suitcase. The pull handle is a rectangular cross-section rod with a hand grip at one end and two pins protruding 90 degrees to its axis at its other end. The housing cover includes a channel, allowing the pull handle rod to slide longitudinally inside the housing. A manually adjustable bridge stop is located about midway along the housing length, so that the pull handle may be used with only half its length extended, providing a rigid handle for pulling a suitcase. The pull handle can also be used fully extended and pivoted on the end of the housing at any comfortable angle for pulling a suitcase.

Accordingly, it is an object of the present invention to provide a simple attachable pull handle for suitcases.

Another object is to provide a pull handle which can be stowed, can be extended rigidly halfway or fully extended and pivoted at an angle to the suitcase.

An advantage of the present invention is its extreme simplicity, (it uses no springs) and its adaptibility to any size suitcase.

Further objects and advantages will become apparent from a study of the following portion of the specification, the claims and the attached drawings.

BRIEF DESCRIPTION OF THE DRAWINGS

FIG. 4 is a perspective view of the present invention device;

FIG. 5 is a side elevation cross-section view of the invention device taken along line 5—5 of FIG. 4;

FIG. 6 is a plan view of the device with its housing cover removed, particularly showing detail of the pull handle rod and pins and its housing construction;

FIG. 7 is an end elevation cross-section view of the device taken along line 7—7 of FIG. 5, particularly showing the housing cover channel to hold and guide the pull handle rod along the housing length;

FIGS. 9 and 10 are expanded views of the central area of the side elevation cross-section of the device, particularly showing detail of the bridge stop flap and its action in retaining the pull rod pins, releasing them or permitting a sliding return of the pull rod to its stowed position.

DESCRIPTION OF THE PREFERRED EMBODIMENT

Figure 1:
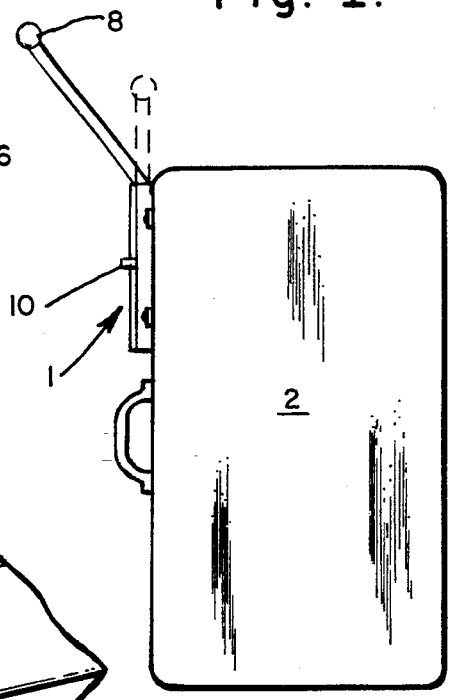
FIG. 1 shows the pull handle device mounted on the top side of a suitcase.
Figure 2:
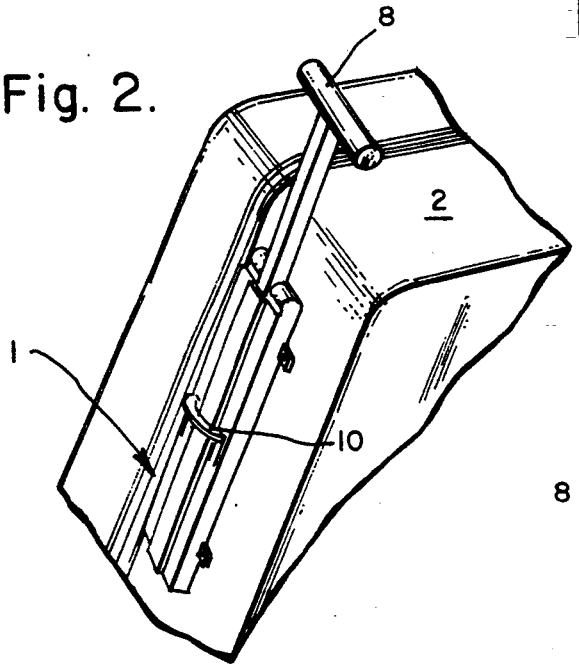
FIG. 2 is a partial perspective view of a suitcase and the present invention, particularly showing the pull handle extended out half of its length and held by a stop.
Figure 3:
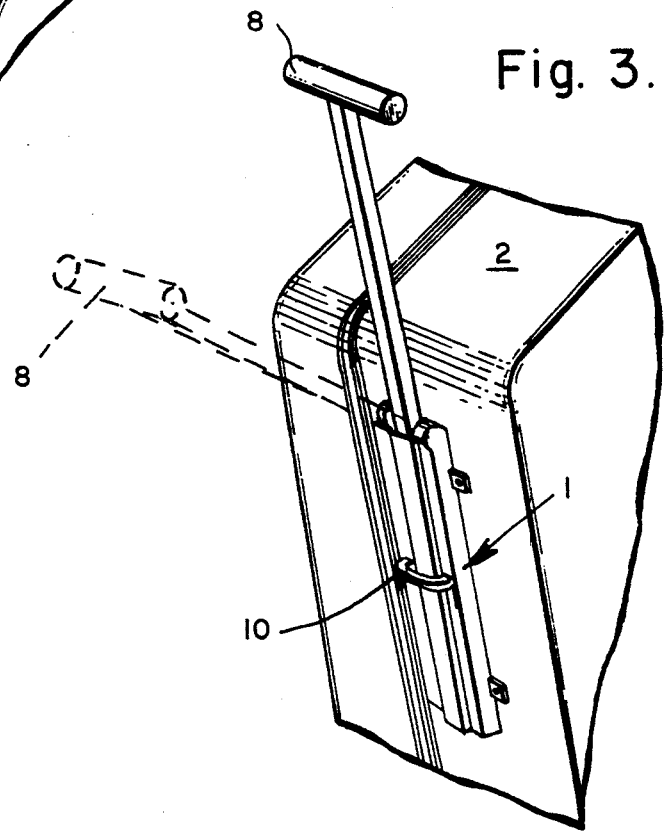
FIG. 3 is a partial perspective view of a suitcase and the present invention, particularly showing the pull handle fully extended and pivoting on its end at an angle.

Referring particularly to FIGS. 1, 2 and 3, there are shown three views of an attachable pull handle device 1 according to the present invention, attached to the top side of a suitcase 2.

In FIG. 1, the pull handle is stowed inside its housing with its handle grip protruding. FIG. 2 shows the pull handle 8 extended out at half its length. In this position, a bridge stop 10 which is located about half way along the length of the pull handle 8 on its housing, is in its normally closed position, preventing the pull handle 8 from being withdrawn further than halfway.

In the FIG. 3 view, the bridge stop 10 has been pulled up and the pull handle 8 is fully extended. As illustrated, the pull handle 8 may now be pivoted on the end of its housing. Thus, as shown, there are several positions available for using the pull handle on a suitcase. The pull handle 8 may be stowed, pulled out halfway remaining rigid, or pulled out its full length and pivoted on its end at any angle. Each of these positions and pull handle angles could be selected for the comfort of short or tall persons when pulling a trailing suitcase along a hall.

Refer now to FIG. 4 which is a perspective view of the invention attachable pull handle device 1. The device 1 comprises a housing cover 4, a housing portion 6, a pull handle 8, first adjustable means 10 for stopping forward movement of the pull handle, second means 12 for fastening the housing cover 4 to the housing portion 6, and third means 14 for attaching the housing portion 6 to a suitcase.

The housing cover 4 is a rectangular sheet of plastic material, shaped to form a channel or wide groove at its center axis, running down its length. The groove width is sized to accommodate the pull handle 8 rod width with clearance, so as to be able to guide and slidably retain the pull handle rod.

The housing portion 6 is formed as an open top, plastic rectangular box, with one end being semi-cylindrical 16 in shape. The semi-cylindrical end 16 is cut at its center to permit movement of the pull handle 8 rod. The length of the housing portion is sized to accommodate most of the length of the pull handle 8, allowing the handle to be fully stowed except for the handle grip.

In the preferred embodiment of the device, the first adjustable means is a bridge stop 10 which is attached to the housing cover 4 about halfway along the cover 4 length and across the cover width. The second means for fastening the housing cover 4 comprises four threaded screws 12 acting together with threaded holes in corner gussets 22 located inside the corners of the housing portion 6.

The third means comprises four rigid plastic tabs 14 which are attached or formed to the bottom outer side edges of the housing portion 6. Each tab 14 has a hole bored in it to accommodate a fastening screw for attaching the device to a suitcase. Other possible mechanizations of the second and third means come to mind: The housing cover 4 may be glued to the housing portion 6 or fastened by catches. Similarly, adhesives or strapping may be used to fasten the pull handle housing to a suitcase.

Refer to FIGS. 5, 6, 7 and 8. FIG. 5 is a cross-section view of the device taken along lines 5—5 of FIG. 4. Note that the section line is zig-zaged to start at a fastening screw 12 and go down the center of the housing cover 4, turning at the housing end across the pull handle grip. This view shows the pull handle 8 fitting tightly in the housing. At the semi-cylindrical end 16 of the housing portion 6, a recess 18 is formed and sized to accommodate two pins 20 which protrude at 90 degrees to the pull handle rod axis at its distal end.

The recess 18 and rod pins 20 permit the pull handle 8 to be retained and pivoted at the semi-cylindrical end 16 of the housing portion when the handle 8 is fully extended. This can be seen further in FIG. 6, which is a plan view of the device with its cover removed. As shown in FIG. 6, the pull handle 8 is in its stowed position. The handle 8 is configured as a rectangular section rod, having a grip handle attached to one end of the rod, and two pins 20 protruding horizontally at 90 degrees to the rod axis at its distal end. A cut opening in the housing semi-cylindrical portion 16, shown in FIG. 8, permits the pull handle rod to slide back and forth.

Figure 8:
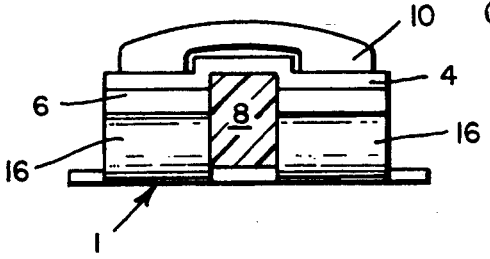
FIG. 8 is an end elevation view of the present invention device with its grip handle removed for clarity of detail.

FIGS. 7 and 8 further illustrate the function of the grooved portion of the housing cover 4 in guiding and retaining the rectangular shaped rod portion of the pull handle 8.

Referring now to FIGS. 9 and 10, there are shown detail of the shape and operation of the bridge stop 10. The bridge stop 10 comprises a plastic bridge member which straddles the channel of the housing cover, and two flap members 11 each of which being attached to one end of the bridge member and at 90 degrees to the bridge member plane, forming two rigid parallel arms. The free ends of the two flap members 11 are pivotally attached by a plastic hinge to the edges of a slot cut in the housing cover 4, so that the two flap members 11 are parallel with the long axis of the cover and normally fit flush with the cover surface. Each of the two flap members 11 include a sawtooth shaped portion 24 which protrudes into the housing 6 inner space when the bridge stop 10 is pushed down.

When the bridge stop 10 is down as shown in FIG. 9, the pins 20 at the inside end of the pull handle 8 are blocked from forward movement by the sawtooth portion 24 of the bridge stop flap. Reverse movement by the pull handle 8 is permitted by the bridge stop flap as the pins 20 cause the bridge stop flap to ride up as shown in FIG. 10. In order to extend the pull handle 8 to its full length, the bridge stop 10 must be manually lifted and pivoted outwards. This will allow the pull handle 8 to be slid out to its full length and pivoted on the end of the housing.

From the foregoing description, it is apparent that the described preferred embodiment achieves the objects of the present invention. Various modifications of the embodiment will be apparent to those skilled in the art. These and other alternatives are considered to be equivalent and within the spirit and scope of the present invention.

Having described the invention, what is claimed is:

1. An attachable pull handle device for a roller mounted suitcase, comprising in combination:

a pull handle, comprising an elongated rectangular cross-section rigid plastic rod having a rod height approximately one third greater than its width, a handle grip means and two cylindrical pins, said handle grip means being attached to one end of said rod forming a "T" shape, said cylindrical pins being attached near the distal end of said rod, projecting at 90 degrees to the longitudinal axis of said rod and forming pivot axis pins for said pull handle;

a housing made of rigid plastic, having an elongated rectangular open-top box shape, said housing having a length and inside width sufficient to permit said pull handle to fit inside said housing lengthwise with said handle grip means protruding externally from one end of said housing, said housing having a bottom wall, opposed side walls, a first end wall and an opposing second end wall, said walls having a height less than said rod height, causing the top longitudinal surface of said rod to protrude above said walls when said rod is placed inside said housing, said second end wall having a semi-cylindrical shape and having a cutout at its center sized to permit said rod of said pull handle to move slidably through said second end wall, said second end wall also including a recess cut in it to receive said pivot axis pins of said pull handle, pivotally supporting the end of said pull handle, said recess being located horizontally, across the width of said second end wall, and at a height above said bottom wall equal to the height of said pivot axis pins above the bottom surface of said rod, said recess having a depth and width dimension and horizontal orientation sufficient to enable mating with said pivot axis pin;

a housing cover made from rigid plastic sheet, said housing cover having a rectangular shape and sized to fit over the top of said housing, said housing cover including a channel formed along its center longitudinal axis, said channel being located, oriented, shaped and dimensioned to fit closely over the longitudinal top surface of said rod of said pull handle, and slidably gripping a portion of the rod sides when said rod is placed in said housing, allowing said rod to move lengthwise in sliding contact while retaining said rod from sideway movement;

a means for stopping or adjusting forward movement of said pull handle, said means being located, attached to said housing cover approximately at the mid point of its length, permitting said pull handle rod to be pulled out halfway and stopped, becoming a rigid handle or when said means is manually adjusted, permitting said pull handle to be fully extended and pivoted as desired;

a means for fastening said housing cover to the top of said housing; and a means for attaching said housing to a suitcase, said pull handle then being ready for extension and use in pulling said suitcase.

2. An attachable pull handle device according to claim 1 wherein said means for stopping or adjusting forward movement of said pull handle includes a bridge stop, said bridge stop comprising a plastic bridge member and two flap members; said plastic bridge member being shaped to bridge said channel running down the center of said housing cover, said two flap members each being attached to the ends of said bridge member at 90 degrees to the bridge member plane, forming two rigid, parallel arms, each said flap member including a sawtooth shaped portion which projects downwards into said housing space; said bridge stop being pivotally attached by plastic hinges, attaching the ends of said flap members, to the edges of two slots cut in said housing cover, said sawtooth shaped portion then acting to stop the projecting pins of said pull handle from being moved past said bridge stop located at said housing cover mid point.

* * * * *